US008608002B2

(12) United States Patent
Hennebelle

(10) Patent No.: US 8,608,002 B2
(45) Date of Patent: Dec. 17, 2013

(54) ERGONOMIC CLOSURE COMPRISING RIBS

(75) Inventor: Frederique Hennebelle, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 1574 days.

(21) Appl. No.: 11/158,823

(22) Filed: Jun. 22, 2005

(65) Prior Publication Data

US 2006/0000792 A1 Jan. 5, 2006

Related U.S. Application Data

(60) Provisional application No. 60/581,907, filed on Jun. 22, 2004.

(51) Int. Cl.
*B65D 41/00* (2006.01)

(52) U.S. Cl.
USPC ..... 215/354; 215/329; 215/296; 222/111; 40/311

(58) Field of Classification Search
USPC ..... 215/228, 354, 329, 295, 296, 355, 305, 215/200, 201, 230; 222/111, 109, 108; 73/426; 206/459.5; 40/311
See application file for complete search history.

(56) References Cited

U.S. PATENT DOCUMENTS

| | | | | |
|---|---|---|---|---|
| 4,273,247 | A * | 6/1981 | Earls | 215/228 |
| 4,416,381 | A * | 11/1983 | Swartwout | 215/228 |
| D296,672 | S * | 7/1988 | Bouthillier | D9/453 |
| 4,890,770 | A * | 1/1990 | Haga et al. | 222/109 |
| 5,316,054 | A * | 5/1994 | Hall et al. | 141/22 |
| 5,431,306 | A * | 7/1995 | Reid | 222/111 |
| 5,634,496 | A * | 6/1997 | Grabner, Jr. | 138/89 |
| 5,715,960 | A * | 2/1998 | Seymour | 215/295 |
| 5,882,574 | A | 3/1999 | Geisinger | |
| 5,928,681 | A | 7/1999 | Everette et al. | |
| 6,170,717 | B1 * | 1/2001 | Di Giovanni et al. | 222/402.2 |
| 6,257,430 | B1 * | 7/2001 | Rinnie et al. | 215/230 |
| 6,439,409 | B1 * | 8/2002 | Dressel et al. | 215/228 |
| 6,783,014 | B2 * | 8/2004 | Luker | 215/334 |
| 7,097,057 | B2 * | 8/2006 | Classens | 215/247 |
| 7,185,827 | B2 * | 3/2007 | Quintard et al. | 239/55 |
| 7,531,493 | B2 * | 5/2009 | Schroeder et al. | 510/277 |

FOREIGN PATENT DOCUMENTS

| | | |
|---|---|---|
| EP | 1 228 974 A2 | 8/2002 |
| WO | WO 01/98450 A2 | 12/2001 |

OTHER PUBLICATIONS

International Search Report, PCT/US2005/021745, 1 page.

* cited by examiner

*Primary Examiner* — David T. Fidei
*Assistant Examiner* — Raven Collins
(74) *Attorney, Agent, or Firm* — Gary J. Foose

(57) ABSTRACT

A closure for sealing a container comprising a cap having an outer cap surface and an inner cap surface, wherein said cap is capable of being removably attached to the container, and a wall having a first wall edge, a second wall edge, an outer wall surface and an inner wall surface.

25 Claims, 5 Drawing Sheets

ERGONOMIC CLOSURE COMPRISING RIBS

CROSS REFERENCE TO RELATED APPLICATION

This application claims the benefit of U.S. Provisional Application No. 60/581,907, filed Jun. 22, 2004.

FIELD OF THE INVENTION

This invention relates to a closure for sealing a container.

BACKGROUND OF THE INVENTION

Caps for sealing containers are well known in the art. Such caps have been used to seal the contents of a container within the container for a multitude of products including chemical packages, food packages, cleaning packages, and the like. Often, these caps have the additional capability of measuring and/or dosing compositions from the container. Such functionality is typically performed by identifying volume amounts on the inner surface of the cap, usually with lines or markings. The caps are typically removably attached to the container. Additionally, these caps often have additional features relating to such areas as self-draining capabilities. While caps for use with various containers are well known in the art, they continue to have longstanding problems associated with their use.

A major problem with the cap involves the force and/or torque required to remove and/or replace the cap onto the container. The amount of torque required to secure a tight cap application to the container is often larger than the amount of torque that can be comfortably exerted by the human hand. These caps can prove especially challenging for individuals with very small or very large hands, as well as arthritic individuals or older individuals. Several means of coupling a cap to a container have been utilized in the art; however, none have been completely successful at providing a cap that can be easily manipulated by a user. For example, caps having external handles that are fixed to the cap require additional processing to produce as well as remaining difficult to operate.

A cap that is easy and comfortable to use and manipulate with a container has been illusive. Such a cap would provide the benefit of being usable by individuals with large or small hands or even arthritic hands while still effectively sealing a composition within a container. It is desirable for such a cap to incorporate a minimum of parts as well as being formed in a minimum of process steps. The present invention addresses one or more of these problems.

SUMMARY OF THE INVENTION

The present invention relates to a closure for sealing a container comprising a cap having an outer cap surface and an inner cap surface, wherein said cap is capable of being removably attached to the container, and a wall having a first wall edge, a second wall edge, an outer wall surface and an inner wall surface, wherein the outer wall surface at the first wall edge has a flex modulus of less than about 3.95 N/mm, and wherein the wall is functionally connected to the cap.

In one embodiment, the closure comprises a plastic. In another embodiment, the plastic is selected from high density polyethylene, polymethylmethacrylate, polypropylene, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof. In yet another embodiment, the plastic is polypropylene.

In one embodiment of the closure, the first wall edge is non-planar. In another embodiment, the first wall edge is substantially a sinusoid having at least one peak and at least one valley. In yet another embodiment, the sinusoid has at least three peaks and at least three valleys. In still another embodiment the peak has a flex modulus of less than about 1.75 N/mm and the valley has a flex modulus of less than about 3.9 N/mm.

In one embodiment, the closure has at least one rib connecting the outer cap surface and the inner wall surface. In another embodiment the at least one rib has a rib face substantially in the shape of a rectangle, triangle, quadrilateral, square, trapezoid, pentalateral, hexalateral, ellipse, oval, circle, or rhombus.

In one embodiment, the closure is, formed by injection-molding. In another embodiment, the closure is formed from one substantially continuous piece of plastic.

In one embodiment, the closure is capable of being threadably attached to a container. In another embodiment, the closure has at least one measuring marking on the inner cap surface.

In one embodiment, the closure further contains a support comprising an upper support surface and a lower support surface wherein the support is between the outer cap surface and the inner wall surface. In another embodiment, the lower support surface further comprises a sealing portion. In one embodiment, the container is functionally connected to the closure. In one embodiment, the container may be translucent or substantially translucent. In another embodiment, the container may be opaque.

In one embodiment, a kit is included for treating fabrics containing a laundry active, the container and the closure.

The present invention also relates to a closure for sealing a container comprising a cap comprising an outer cap surface and an inner cap surface, wherein said cap is capable of being removably attached to the container, a wall comprising a first wall edge, a second wall edge, an outer wall surface and an inner wall surface wherein the first wall edge is non-planar, and at least one rib connecting the outer cap surface and the inner wall surface.

In one embodiment, the closure comprises a plastic. In another embodiment, the plastic is selected from high density polyethylene, polymethylmethacrylate, polypropylene, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof.

In one embodiment of the closure, the first wall edge is substantially a sinusoid having at least one peak and at least one valley. In another embodiment of the closure, the sinusoid has at least three peaks and at least three valleys.

In one embodiment, the at least one rib has a rib face substantially in the shape of a rectangle, triangle, quadrilateral, square, trapezoid, pentalateral, hexalateral, ellipse, oval, circle, or rhombus. In one embodiment, the closure contains at least four ribs.

In one embodiment, the closure is formed by blow-molding. In another embodiment, the closure is formed from one substantially continuous piece of plastic.

In one embodiment the closure is releasably threadably attached to the closure. In one embodiment the closure includes at least one measuring marking on the inner cap surface.

In one embodiment, a kit is included for treating fabrics containing a laundry active, the container and the closure.

In one embodiment, the closure includes a support having an upper support surface and a lower support surface wherein the support is between the outer cap surface and the inner wall surface. In another embodiment, the lower support surface further comprises a sealing portion.

The present invention also relates to a closure for sealing a container comprising a cap comprising an outer cap surface and an inner cap surface, wherein said cap is capable of being removably attached to the container and wherein the inner cap surface comprises at least one measuring marking, and a wall comprising a first wall edge, a second wall edge, an outer wall surface and an inner wall surface, wherein said inner wall surface is functionally attached to the outer cap surface, and wherein the first wall edge is non-planar.

In one embodiment, a kit is included for treating fabrics containing a laundry active, the container, the closure and instructions to fill the closure with the laundry active to the measuring marking. In one embodiment, the instructions are located on the container.

DETAILED DESCRIPTION OF THE INVENTION

Figure 1:
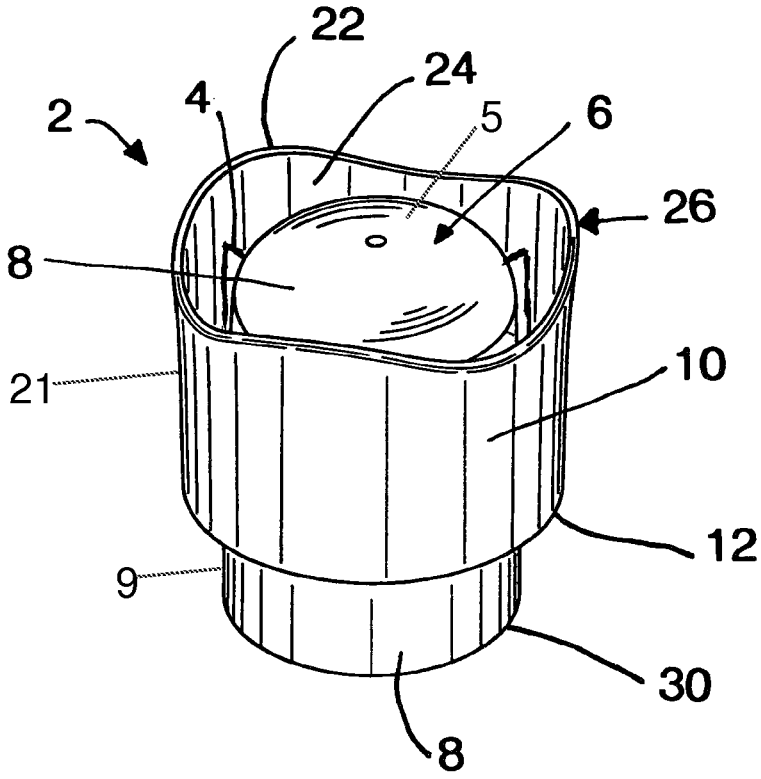
FIG. 1 is a top perspective view of the closure.
Figure 2:
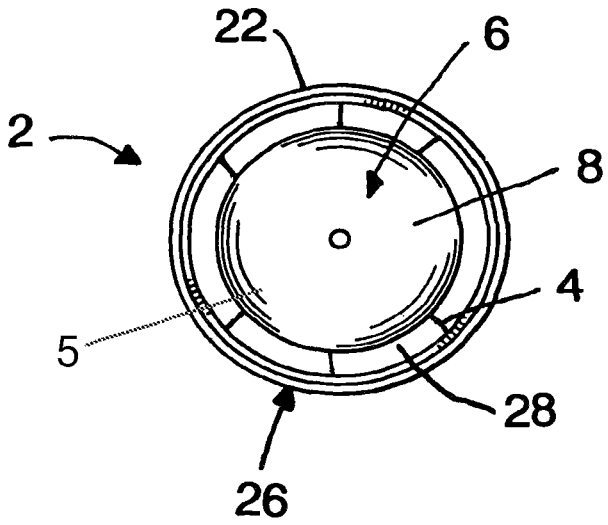
FIG. 2 is a top view of the closure.
Figure 3:
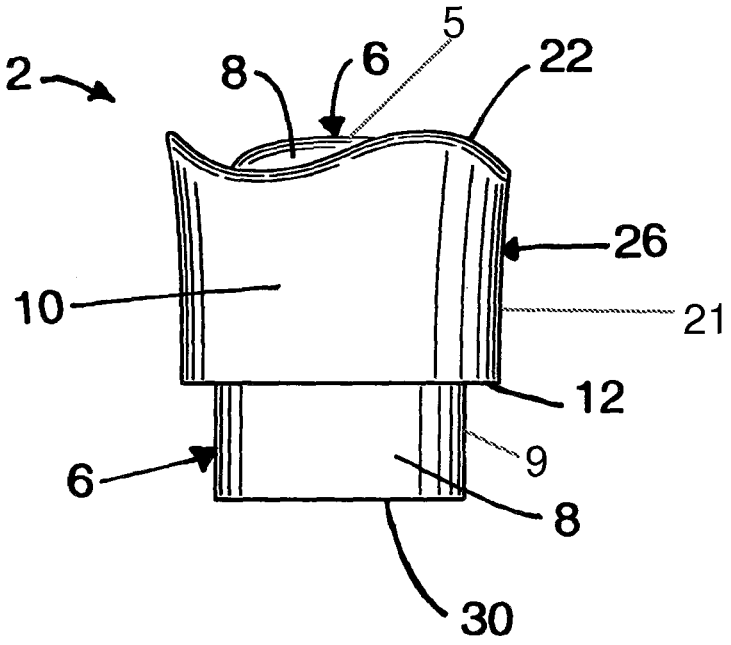
FIG. 3 is a front view of the closure
Figure 4:
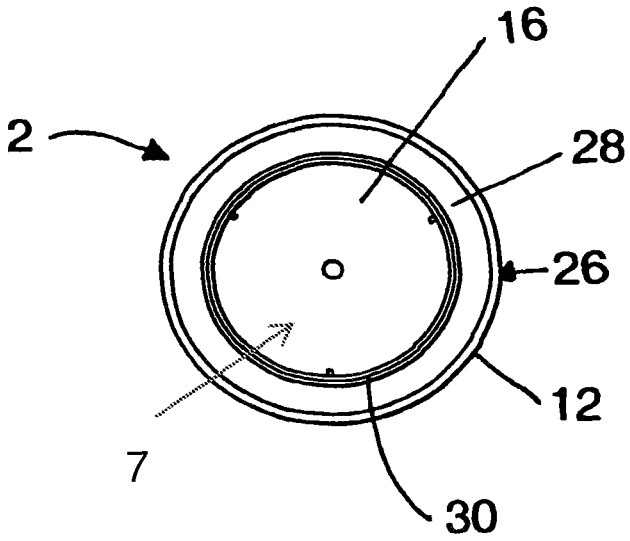
FIG. 4 is a bottom view of the closure

While the specification concludes with the claims particularly pointing and distinctly claiming the invention, it is believed that the present invention will be better understood from the following description.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages and ratios used herein are by weight of the total composition and all measurements made are at 25° C., unless otherwise designated. An angular degree is a planar unit of angular measure equal in magnitude to 1/360 of a complete revolution.

All measurements used herein are in metric units unless otherwise specified.

It has now surprisingly been discovered that the closure of the present invention is more easily utilized and operated. Further, the closure provides for increased gripping surface for operation.

Without wishing to be bound by theory, it is believed that the increased flexing of the wall allows the wall to deform to the user's hand or hands. This deformation allows for increased surface contact within the hand or hands of the user. By increasing the amount of surface contact between the surface of the closure and the hand, it is believed that energy generated by the hand is transferred to the closure more efficiently, thereby decreasing the ability required to remove the closure from containers and the like.

In one embodiment, the use of one hand to operate the present invention is contemplated. However, it is contemplated that methods utilizing more than one hand from at least one user can be utilized. Further, it is contemplated that individuals having varying disabilities utilizing various hand substitutes such as artificial limbs or hooking or grasping mechanisms and the like can utilize the present invention. Such an artificial limbs, hooking mechanisms, and/or grasping mechanism are considered as hands within the context of this invention. It is also contemplated that the left hand or the right hand can be used for the purpose of the present invention.

As used herein, "container" refers to a hollow or partially hollow vessel capable of maintaining a composition for an indefinite period of time. The container may be free standing, substantially rigid, flexible and malleable, a malleable bag, a malleable sachet, a malleable pouch, and combinations of such forms. A preferred form is a free-standing container having an opening for pouring or dispensing a composition from the container under the influence of gravity. The container can preferably be opened and closed repeatedly at the opening; however, containers that can only be opened once without resealing can likewise be utilized.

As used herein, "composition" refers to any material contained within the container. Compositions of this invention include fluids and fluidizable solids (solid particles small enough to pour in a fluid-like manner, such particles typically having an effective diameter of less than about 2.6 cm). These compositions are typically homogenous in nature; however, heterogeneous compositions and multiphase compositions are contemplated.

Cap

In one embodiment, the present invention includes a cap having an outer cap surface, an inner cap surface, and a cap edge. The cap is of a shape and design that it is capable of containing a volume of a composition for an indefinite period of time.

In one embodiment, the inner cap surface further comprises at least one measuring marking. Such a marking is used such that when a composition from the container is added to the closure to the measuring marking, a specified volume is contained within the cap of the closure. In another embodiment, the composition is added to the closure until it substantially reaches the cap edge.

Wall

The wall of the present invention comprises an inner wall surface, an outer wall surface, a first wall edge and a second wall edge. The first wall edge is distally located from the cap edge, while the second wall edge is proximally located from the cap edge. The inner wall surface is proximally positioned in reference to the cap while the outer wall surface is distally positioned in reference to the cap. In one embodiment, the wall is functionally attached to the cap. In another embodiment, the inner wall surface is functionally attached to the outer cap surface.

In one embodiment, the first wall edge is substantially planar. In another embodiment, the first wall edge is substantially non planar. Where the first wall edge is substantially non planar, a sinusoid shape is one non-limiting structure contemplated. The sinusoid shaped, disclosed herein, includes shapes substantially sinusoidal in shape. In one embodiment, the sinusoid has at least one peak and one valley. In another embodiment, the sinusoid ahs at least three peaks and three valleys. Without being bound by theory, it is believed that the sinusoid shape of the first wall edge imparts structural stability to the wall of the closure at the valleys of the sinusoid while allowing additional flex of the walls at the peaks.

In one embodiment, the second wall edge is substantially planar. In another embodiment, the second wall edge is substantially non planar. Where the second wall edge is substantially non planar, a sinusoid shape is one non-limiting structure contemplated. In one embodiment, the sinusoid has at least one peak and one valley. In another embodiment, the sinusoid ahs at least three peaks and three valleys.

In one embodiment, a support comprising an upper surface and a lower surface is utilized to functionally attach the wall to the cap. The support can be continuous or discontinuous in shape. Any cross sectional shape of a support capable of securing or attaching the wall to the cap can be utilized. Such shapes include, but are not limited too, shapes substantially in the shape of a rectangle, triangle, quadrilateral, square, trapezoid, pentalateral, hexalateral, ellipse, oval, circle, rhombus, or combinations thereof.

The lower surface of the support can optionally comprise a sealing portion. Without wishing to be bound by theory, it is believed that the sealing portion provides increased sealing ability between the closure and the container. Any sealing portion capable of increasing the sealing ability between the closure and the container can be used. Such sealing portions are typically at least partially compressible by the force required to secure the closure onto the container. Sealing portions may be made of any substance that can at least partially deflect or compress and include, but are not limited to, elastomers and elastomeric resins, rubbers, plasticized and non-plasticized plastics, glues, sponges, and the like.

In another embodiment, at least one rib having a rib face is utilized to functionally attach the wall to the cap. It is contemplated that the rib of the present invention can be utilized with the support or independent of the support. Any shape of the rib face capable of securing and/or attaching the wall to the cap or stiffening the wall can be used. In a non-limiting embodiment, such a rib face is substantially in the shape of a rectangle, triangle, quadrilateral, square, trapezoid, pentalateral, hexalateral, ellipse, oval, circle, rhombus or combinations thereof.

Optionally, threading or other attachment mechanisms can be affixed and/or molded into the closure of the present invention. One of ordinary skill in the art would readily know where to place threading, as well as identify the best surfaces for the location of threading. In one embodiment, threading is capable of being affixed and/or molded into the closure on the outer wall surface, the inner wall surface, the inner cap surface, and/or the outer cap surface.

Wall Flexibility

In one embodiment, the flexibility of the wall is used to provide a benefit to the closure. Without wishing to be bound by theory, it is believed that the flexibility of the wall in the hand of the user directly affects the amount of force the user is able to transfer to the closure.

The flexibility of the wall is measured by calculating a flex modulus of the wall. The flex modulus of the wall of the closure is determined by placing the closure in a compression tester. An exemplary tester is the Lloyd Instruments LR 5K compression tester. The load cell of the compression tester is set to a maximum of 500 N. The base of the cell is circular with a diameter of 16 mm. The testing speed is set to 12.5 mm/min. The die of the compression tester is then placed on the closure such that the center of the die is on the outer wall surface at the first wall edge.

In one embodiment of the invention, the outer wall surface at the first wall edge has a flex modulus of less than about 3.95 N/mm. In another embodiment, the outer wall surface at the first wall edge has a flex modulus of less than about 3.5 N/mm. In another embodiment, the outer wall surface at the first wall edge has a flex modulus of less than about 3 N/mm. In another embodiment, the outer wall surface at the first wall edge has a flex modulus of less than about 1.75 N/mm. In another embodiment, the outer wall surface at the first wall edge has a flex modulus of less than about 1.60 N/mm. In another embodiment, the outer wall surface at the first wall edge has a flex modulus of less than about 1.45 N/mm. In another embodiment, the outer wall surface at the first wall edge has a flex modulus between about 1.00 N/mm and about 5 N/mm. In another embodiment, the outer wall surface at the first wall edge has a flex modulus between about 1.4 N/mm and about 4 N/mm.

In one embodiment, the flex modulus of the wall is substantially homogenous throughout the wall. In another embodiment, the flex modulus of the wall is heterogeneous. The flex modulus can be made heterogeneous by varying many parameters including wall thickness, wall shape, wall materials and the like. In one non-limiting embodiment, the closure of the present invention has a sinusoidal first wall edge. The flex modulus at the peak of the outer wall surface at the first wall edge is less than about 1.75 N/mm; while the valley of the outer wall surface at the first wall edge has a flex modulus of less than about 3.9 N/mm. In an alternative embodiment, the flex modulus at the peak of the outer wall surface at the first wall edge is less than about 1.60 N/mm; while the valley of the outer wall surface at the first wall edge has a flex modulus of less than about 3.00 N/mm. In another alternative embodiment, the flex modulus at the peak of the outer wall surface at the first wall edge is less than about 1.45 N/mm; while the valley of the outer wall surface at the first wall edge has a flex modulus of less than about 2.25 N/mm. In yet another alternative embodiment, the flex modulus at the peak of the outer wall surface at the first wall edge is less than about 1.44 N/mm; while the valley of the outer wall surface at the first wall edge has a flex modulus of less than about 2.15 N/mm. In yet another alternative embodiment, the flex modulus at the peak of the outer wall surface at the first wall edge is between about 1.00 N/mm and about 2.00 N/mm; while the valley of the outer wall surface at the first wall edge has a flex modulus of between about 2 N/mm and about 4 N/mm.

Materials

The closure of this invention can be made of any material known by one of ordinary skill in the art capable of holding compositions in place for an indefinite period of time. Such materials include, but are not limited to, metals, woods, plastics, ceramics, and combinations thereof. Plastics are preferred. Preferable plastics include thermoform plastics and thermoset plastics. Such plastics include, but are not limited to high density polyethylene, polymethylmethacrylate, polypropylene, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof.

In one embodiment, substantially transparent or translucent plastics are used to form the closure. Substantially transparent or translucent plastics have a light transmission of at least about 70%, more preferably at least about 80%, and even more preferably at least about 90%. Polyethylene terephthalate is a plastic known to exhibit these characteristics. Likewise the materials may be processed in single or multiple layers. Because a variety of different materials may be used in the construction of the closures of the present invention the materials selected will be based on the intended end use and characteristics required of such a closure.

It is readily known to one of ordinary skill in the art that the material used to form the closure can possess wide range of colors and hues. One of ordinary skill would readily know how to color and process the materials used to form the container to achieve any variations in color, as well as degrees of transparency including see-through clear, translucent, translucent, and opaque.

The formation of the closure will vary according to the container material selected. In one embodiment, the closure of the present invention is formed from a plastic. An exemplary way of forming a plastic is by blow-molding. By blow-molding in one step, the container can be formed at a reduced cost and with the ideal minimum number of process operations. The container of this invention is as easy and simple to produce as a comparable sized closure without the flexible walls of the present invention, with no increase in material and process time. By blow molding in a single manufacturing step, the closure can be blow molded without the need for reforming and heating. While blow-molding can be used to produce the container of the present invention, other methods, including other blow-molding variants, may be used. For instance, the methods disclosed in U.S. Pat. Nos. 5,882,574 and 5,928,681 may be used.

In another embodiment, the closure of the present invention further comprises instructions for communicating with a user. The instructions can be printed or placed directly on the closure or the container in the form of a label. One of ordinary skill in the art would readily know how to print instructions on a closure or container made from a particular material. Likewise, one of ordinary skill in the art would readily know how to affix or attach a label to a closure or container.

The closure can optionally be used to dose compositions from within a container. In one embodiment, the composition is added to the closure, wherein the closure is filled substantially completely. In another embodiment, the closure further comprises at least one measuring marking on the inner cap surface such that when the composition from the container is added to the closure to the measuring marking, a specified volume is contained within the closure.

Compositions

While any composition can be used with the closure of this invention, the closure of this invention is particularly suited to laundry actives which include, bur are not limited to, laundry care compositions, laundry detergents, laundry softeners, laundry treatment compositions and the like. Particularly well suited are laundry actives suited for laundry care compositions. In one embodiment, the laundry active is a laundry softener.

In one embodiment, the closure is included in a kit with a laundry active and a container. The kit may optionally include instructions for use of the kit.

EXAMPLES

Figure 5:
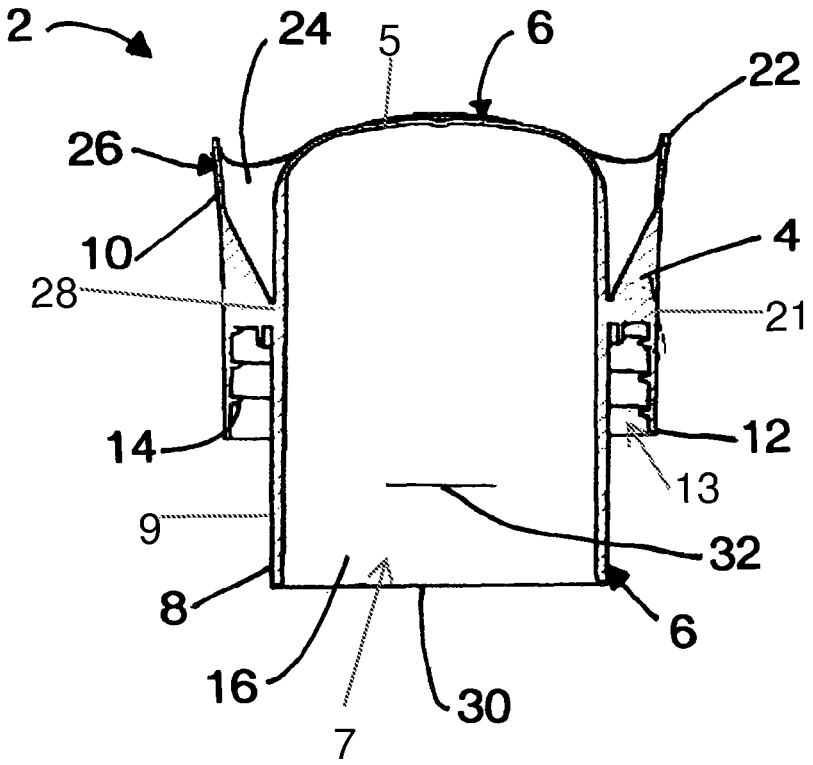
FIG. 5 is a cross-section of the closure.

Embodiments shown and described herein are more readily understood by examining the non-limiting drawings. FIGS. 1-5 illustrate a closure 2. Located at the center of the closure 2 is a cap base portion 5, a cap sidewall 9 connected to the cap base portion 5, an outer cap surface 8 and an inner cap surface 16 disposed on opposite sides of the cap sidewall 9, a cap opening 7 positioned at an end of the cap opposite the cap base portion 5, and a cap edge 30 surrounding the opening 7. Optional measuring markings 32 are located on the inner cap surface 16 that indicate fill/dosage amounts. The closure 2 also includes a wall 26 that at least partially encompasses and is connected to the cap. The wall 26 includes a first wall edge 22, a second wall edge 12, and a central wall portion 21 positioned between the first and second wall edges 22 and 12, respectively. The wall 26 also includes an outer wall surface 10 and an inner wall surface 24. In one embodiment, the inner wall surface 10 of the central wall portion 21 is connected to the outer cap surface 8 of the cap 6 by a support 28 as shown in FIG. 5. As also shown in FIG. 5, the first and second wall edges 22 and 12, respectively, are cantilevered from the central wall portion 21 and/or the support 28 such that the first and second wall edges 22 and 12, respectively, are separated from, and thus do not engage or connect to, the cap.

Additional support of the wall 26 can be achieved by the placement of one or more ribs 4 between the outer cap surface 8 of the cap 6 and the inner wall surface 24 of the wall 26. In embodiments containing the one or more ribs 4, the first and second wall edges 22 and 12, respectively, may also be cantilevered from the one or more ribs 4 such that the first and second wall edges 22 and 12, respectively, are separated from, and thus do not engage or connect to, the cap. The ribs 4 can be of any shape capable of providing additional support to the wall 26. The second wall edge 12 may be separated from the cap sidewall 9 such that an annular space 13 is disposed between the outside cap surface 8 and the inner wall surface 24, wherein the annular space 13 as shown in FIG. 5. Threads 14 or other connecting mechanisms for connecting the closure to a container can optionally be located on the inner wall surface 24 within the annular space 13 as illustrated in FIG. 5, the outer wall surface 10, the inner cap surface 16, or the outer cap surface 8.

All documents cited in the Detailed Description of the Invention are, relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A closure for sealing a container comprising:

a cap comprising a cap base portion, a cap sidewall connected to the cap base portion, an outer cap surface disposed on the cap sidewall, an inner cap surface disposed on the cap sidewall, and an opening disposed at an end of the cap opposite the cap base portion; and a wall at least partially encompassing the cap, the wall comprising a first wall edge, a second wall edge spaced apart from the first wall edge, an outer wall surface, and an inner wall surface, wherein said inner wall surface is attached to the outer cap surface by a support, wherein the second wall edge is separated from the outer cap surface to form an annular space for receiving a container; and;

threads disposed on the inner wall surface adjacent to the second wall edge for threadingly engaging said container;

wherein:

the first wall edge is disposed adjacent to and separated from the cap base portion, and the outer wall surface at the first wall edge has a flex modulus of less than about 3.95 N/mm.

2. The closure of claim 1, wherein the first wall edge is substantially a sinusoid comprising at least one peak having a flex modulus of less than about 1.75 N/mm and at least one valley having a flex modulus of less than about 3.9 N/mm.

3. The closure of claim 2, wherein the sinusoid comprises at least three peaks and at least three valleys.

4. The closure of claim 1, wherein the closure comprises an injection-molded closure.

5. The closure of claim 1, further comprising at least one measuring marking disposed on the inner cap surface.

6. The closure of claim 1, wherein the wall further comprises a central wall portion disposed between the first and second wall edges, and wherein the first and second wall edges are cantilevered from the central wall portion.

7. The closure of claim 6, further comprising a rib, wherein the rib connects the inner wall surface to the outer cap surface such that the first and second wall edges are cantilevered from the rib.

8. The closure of claim 6, wherein the rib further comprises at least three ribs.

9. The closure of claim 6, further comprising a rib, wherein the rib connects the inner wall surface to the outer cap surface such that the first and second wall edges are cantilevered from the rib, said closure further comprising a support connecting the central wall portion to the cap such that the first and second wall edges are cantilevered from the rib.

10. The closure of claim 9, further comprising at least three ribs connected to the support and connecting the inner wall surface to the outer cap surface.

11. The closure of claim 9, wherein the support comprises a lower support surface and an upper support surface, the lower support surface further comprising a sealing portion.

12. The closure of claim 1, further comprising a cap edge surrounding the opening, wherein the first wall edge is at an opposite end of the closure from the cap edge.

13. A kit for treating fabrics comprising:

a laundry active;

a container; and a closure for sealing a container, said closure comprising:

a cap comprising a cap base portion, a cap sidewall connected to the cap base portion, an outer cap surface disposed on the cap sidewall, an inner cap surface disposed on the cap sidewall, and an opening disposed at an end of the cap opposite the cap base portion; and a wall at least partially encompassing the cap, the wall comprising a first wall edge, a second wall edge spaced apart from the first wall edge, an outer wall surface, and an inner wall surface, wherein said inner wall surface is attached to the outer cap surface by a support, wherein the second wall edge is separated from the outer cap surface to form an annular space for receiving a container; and threads disposed on the inner wall surface adjacent to the second wall edge for threadingly engaging said container;

wherein:

the first wall edge is disposed adjacent to and separated from the cap base portion, and the outer wall surface at the first wall edge has a flex modulus of less than about 3.95 N/mm.

14. The closure of claim 1, wherein the first wall edge is nonplanar.

15. A closure for sealing a container comprising:

a cap comprising a cap base portion, a cap sidewall connected to the cap base portion, an outer cap surface disposed on the cap sidewall, an inner cap surface disposed on the cap sidewall, and an opening disposed at an end of the cap opposite the cap base portion; and a wall at least partially encompassing, the wall comprising a first wall edge, a second wall edge spaced apart from the first wall edge, an outer wall surface, and an inner wall surface, wherein said inner wall surface is attached to the outer cap surface by a support;

wherein:

the first wall edge is disposed adjacent to and separated from the cap base portion, the outer wall surface at the first wall edge has a flex modulus of less than about 3.95 N/mm, and the first wall edge is substantially a sinusoid comprising at least one peak having a flex modulus of less than about 1.75 N/mm and at least one valley having a flex modulus of less than about 3.9 N/mm.

16. The closure of claim 15, wherein the sinusoid comprises at least three peaks and at least three valleys.

17. The closure of claim 15, further comprising at least three ribs, wherein the at least three ribs connect the inner wall surface to the outer cap surface such that the first and second wall edges are cantilevered from the at least three ribs.

18. The closure of claim 17, wherein the at least three ribs comprises four ribs.

19. The closure of claim 15, further comprising a support connecting the inner wall surface to the outer cap surface such that the first and second wall edges are cantilevered from the support.

20. The closure of claim 15, further comprising a support comprising an upper support surface and a lower support surface, wherein the lower support surface further comprises a sealing portion.

21. A kit for treating fabrics comprising:

a laundry active;

a container; and a closure for sealing a container, said closure comprising:

a cap comprising a cap base portion, a cap sidewall connected to the cap base portion, an outer cap surface disposed on the cap sidewall, an inner cap surface disposed on the cap sidewall, and an opening disposed at an end of the cap opposite the cap base portion; and a wall at least partially encompassing the cap, the wall comprising a first wall edge, a second wall edge spaced apart from the first wall edge, an outer wall surface, and an inner wall surface, wherein said inner wall surface is attached to the outer wall surface by a support;

wherein:

the first wall edge is disposed adjacent to and separated from the cap base portion, the outer wall surface at the first wall edge has a flex modulus of less than about 3.95 N/mm, and the first wall edge is substantially a sinusoid comprising at least one peak having a flex modulus of less than about 1.75 N/mm and at least one valley having a flex modulus of less than about 3.9 N/mm.

22. A closure for sealing a container comprising:

a cap comprising:

a cap base portion, a cap sidewall connected to the cap base portion, an outer cap surface disposed on the cap sidewall, an inner cap surface disposed on the cap sidewall, and an opening disposed at an end of the cap opposite the cap base portion; and a wall at least partially encompassing the cap, the wall comprising:

a first wall edge, a second wall edge spaced apart from the first wall edge, an outer wall surface, and
an inner wall surface;
wherein:
the outer cap surface is connected to the inner wall surface by a support such that the first and second wall edges are cantilevered and separated from the cap,
the outer wall surface at the first wall edge has a flex modulus of less than about 3.95 N/mm, and
the first wall edge is nonplanar comprising at least one peak having a flex modulus of less than about 1.75 N/mm and at least one valley having a flex modulus of less than about 3.9 N/mm.

23. The closure of claim 22, wherein the nonplanar first wall edge is a sinusoid.

24. A kit for treating fabrics comprising:
a laundry active;
a container; and
a closure;
wherein said closure comprises:
a cap comprising:
a cap base portion,
a cap sidewall connected to the cap base portion,
an outer cap surface disposed on the cap sidewall,
an inner cap surface disposed on the cap sidewall, and
an opening disposed at an end of the cap opposite the cap base portion; and
a wall at least partially encompassing the cap, the wall comprising:
a first wall edge,
a second wall edge spaced apart from the first wall edge,
an outer wall surface, and
an inner wall surface;
wherein:
the outer cap surface is connected to the inner wall surface by a support such that the first and second wall edges are cantilevered and separated from the cap;
the outer wall surface at the first wall edge has a flex modulus of less than about 3.95 N/mm; the first wall edge is nonplanar comprising at least one peak having a flex modulus of less than about 1.75 N/mm and at least one valley having a flex modulus of less than about 3.9 N/mm;
the closure comprises a measure marking disposed on the inner cap surface; and
the kit further comprises instructions to fill the closure with the laundry active to the measure marking.

25. The kit of claim 24, wherein the instructions are located on the container.

* * * * *